United States Patent [19]

Kudoh et al.

[11] Patent Number: 4,927,390

[45] Date of Patent: May 22, 1990

[54] GAS EXHAUSTION DEVICE FOR INBOARD/OUTBOARD ENGINE

[75] Inventors: Noboru Kudoh; Itsushi Hirukawa; Satoshi Aoki; Tsuyoshi Yoshimura; Shigeki Shiozawa, all of Hamamatsu, Japan

[73] Assignee: Sanshin Kogyo Kabushiki Kaisha, Hamantsu, Japan

[21] Appl. No.: 289,982

[22] Filed: Dec. 22, 1988

[30] Foreign Application Priority Data

Dec. 25, 1987 [JP] Japan ..... 62-327310

[51] Int. Cl.[5] ..... B63H 21/32; B63H 21/38

[52] U.S. Cl. ..... 440/88; 285/23; 440/89

[58] Field of Search ..... 440/88, 89; 285/23, 285/117

[56] References Cited

U.S. PATENT DOCUMENTS 4,801,283 1/1989 Ruhnke ..... 440/89 X

*Primary Examiner*—Sherman D. Basinger

*Attorney, Agent, or Firm*—Ernest A. Beutler

[57] ABSTRACT

An inboard/outboard drive arrangement and specifically an improved exhaust joint therefor wherein at least one of the rigid conduits of the exhaust system is provided with a projection to engage and restrain a hose clamp which may be released and inadvertently dropped so as to prevent loss of the hose clamp into an inaccessible area.

13 Claims, 2 Drawing Sheets

GAS EXHAUSTION DEVICE FOR INBOARD/OUTBOARD ENGINE

BACKGROUND OF THE INVENTION

This invention relates to a gas exhaustion device for an inboard/outboard engine and more particularly to an improved arrangement for interconnecting flexible and rigid components.

In many forms of fluid conduits, one or more rigid conduits are interconnected with each other by means of a flexible conduit. The flexible conduit has its opposite ends connected to the rigid conduits in a telescopic fashion and some form of clamp retains the flexible conduit to the rigid conduits. This type of arrangement is commonly used in the exhaust system for an inboard/-outboard drive wherein the exhaust gases and some or all of the engine coolant are discharged from an inboard mounted engine through the transom of the watercraft to a below the water exhaust gas discharge formed in the lower unit of the outboard drive. Normally, these systems include a number of rigid components that are connected by flexible hoses. Hose clamps retain the hoses in position. With this type of system, it is frequently desirable to remove the flexible hose in order to inspect the conduits and components positioned within them. For example, frequently there may be employed a valve in the conduit that will permit exhaust gases to flow outwardly but which will preclude water from flowing lack into the engine when the engine is not running. Normally, this type of valve is positioned in a vertically extending part of the conduit. When the hose clamp is removed in order to remove the flexible hose, frequently the hose clamp may drop down into the lower portion of the hull. As such, it is very difficult to retrieve and this presents obvious problems.

It is, therefore, a principal object of this invention to provide an improved exhaust gas device for an outboard/outboard engine.

It is another object of this invention to provide an improved arrangement for coupling conduits together in a fluid system.

It is a further object of this invention to provide a fluid coupling system wherein host clamps are employed and that incorporates an arrangement for insuring that the host clamp, even when released, will not become lost.

SUMMARY OF THE INVENTION

This invention is adapted to be embodied in a fluid connection between a rigid conduit, a flexible conduit that is adapted to be telescopically received with the rigid conduit and clamping means for retaining the conduits together. In accordance with the invention, a projection is formed on the rigid conduit positioned to engage the clamping means when the clamping means is released for retaining the clamping means.

DETAILED DESCRIPTION OF THE PREFERRED EMBODIMENTS

Figure 1:
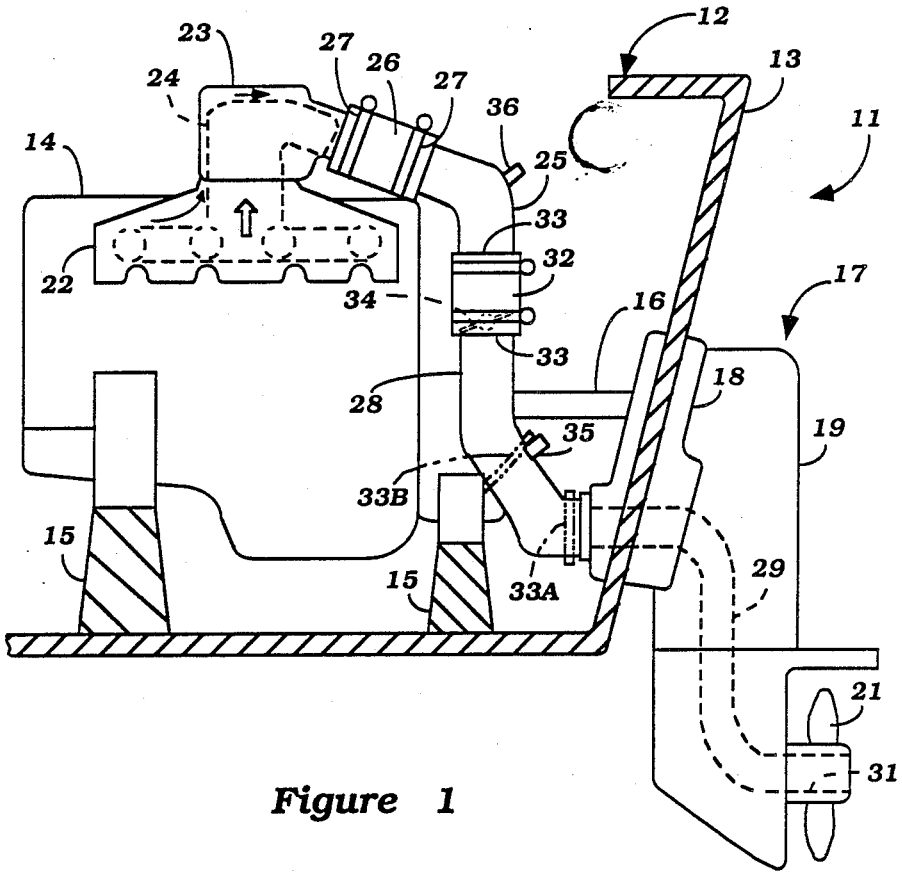
FIG. 1 is a partial side elevational view of a watercraft constructed in accordance with an embodiment of the invention, with portions shown in section.

Referring first to FIG. 1, a watercraft constructed in accordance with an embodiment of the invention is identified generally by the reference numeral 11. The invention is described in conjunction with a watercraft because this is a typical environment wherein the invention has particular utility. However, facets of the invention can be employed in other applications employing fluid conduits.

The watercraft 11 is comprised of a hull 12, which is shown partially, and which includes a transom 13. The watercraft 11 is powered by an inboard/outboard drive arrangement including an internal combustion engine 14 that is jointed within the hull 12 in a suitable manner, as by mounting bosses 15. The engine 12, which may be of any known type, drives a drive shaft 16 that extends through the transom 13 to an outboard drive unit, indicated generally by the reference numeral 17. The outboard drive unit 17 includes a gimbal housing 18 that is affixed to the transom 13 in a known manner and which supports a drive shaft housing lower unit assembly 19 for steering accident about a vertically extending axis and for tilt and trim movement about a horizontally extending axis. A transmission (not shown) is positioned within the outboard drive unit 17 for driving a propeller 21 in a known manner.

The engine 14 is provided with an exhaust system that includes an exhaust manifold 22 that received the exhaust gases from the exhaust ports of the engine and which delivers them to an exhaust joint 23. In addition, cooling water from the jacket of the engine 14 may also be delivered into the exhaust manifold 22 and joint 23 around the periphery of an exhaust passage 24 formed therein.

These exhaust gases and the water are delivered to an exhaust pipe 25 which is connected to the joint 23 by means of a flexible hose 26. The hose 26 is slipped over the rigid ends of the joint 23 and exhaust pipe 25 and is held in position by clamps 27 in a known manner. The exhaust pipe 25 delivers the exhaust gases to a collector pipe 28 which extends downwardly and mates with an exhaust passage 29 formed in the outboard drive unit 17. The exhaust gases are then discharged to the atmosphere through the body of water in which the watercraft is operating through a through the hub discharge 31.

The exhaust pipe 25 and collector section 28 are interconnected by means of a further flexible hole 32 which is held in position on the rigid ends of the exhaust pipe 25 and collector pipe 28 by means of hose clamps 33.

The construction as thus far described may be considered to conventional in inboard/outboard drives. For that reason, the details of the construction are not believed to be necessary to understand the invention.

Normally, the collector section 28 will incorporate a check valve 34 that serves the function of permitting the exhaust gases and coolant from the engine to flow into the collector section 28 and out of the under the water discharge 31. However, when the engine is not running, the valve 34 will close so as to preclude the entry of after back into the engine through its exhaust system. Periodically, it is desirable to inspect the valve 34 and also the exhaust pipe 25 to insure that the exhaust passages of the engine are not clogged. Also, for servicing, it may the necessary to move these components. It should be readily apparent from FIG. 1 that when the clamps 33 are removed, there is a likelihood that they may fall down into the position indicated at 33*a* in phanton lines wherein it will be difficult, if not impossible, for an operator to retrieve them without removal of the entire exhaust system. A similar situation can occur when the clamps 27 are removed.

In order to prevent the loss of the clamps 33 and 37, the collector section 22 is formed with an integral outwardly extending projection 35 that is disposed sufficiently below the joint with the hose 32 to permit the hose 32 to be assembled and disassembled but also at a high enough location so that in the clamps 33 are dropped, they will be held in the position 33*b* where they can be readily retrieved. If desired, a similar projection 36 may be formed on the exhaust pipe 25 for the same purpose.

Figure 2:
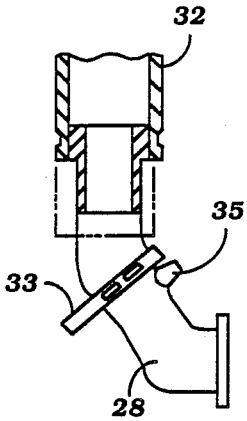
FIG. 2 is an enlarged side elevational view, with a portion shown in section, illustrating the embodiment.
Figure 3:
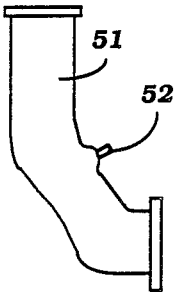
FIG. 3 is a side elevational view, in part similar to FIG. 2 showing another embodiment of the invention.

FIG. 3 shows another embodiment of the invention wherein a collector pipe 51 is provided with a pressed in projection 52 that will serve the same purpose as the integral projection 35 of the embodiment of FIGS. 1 and 2.

Figure 4:
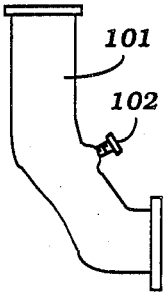
FIG. 4 is a side elevational view, in part similar to FIGS. 2 and 3, showing yet another embodiment of the invention.

FIG. 4 shows another embodiment wherein a collector pipe 101 is formed with a tapped opening into which a bolt 103 may be threaded so as to form a projection to retain the released clamp 33.

Figure 5:
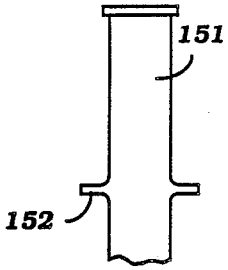
FIG. 5 is a side elevational view, in part similar to FIGS. 2, 3 and 4, showing a further embodiment of the invention.

In the embodiments thus far described, a somewhat discontinuous projection has been formed. FIG. 5 shows another embodiment wherein an exhaust pipe 151 is provided with a continuous circular projection 152 to serve the same purpose.

Figure 6:
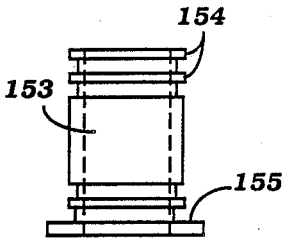
FIG. 6 is a side elevational view, in part similar to FIGS. 2, 3, 4 and 5, showing yet another embodiment of the invention.

FIG. 6 shows yet another embodiment of the invention wherein an exhaust pipe 153 is formed with ribs 154 so as to assist in sealing with the hose 32. The end of the pipe 153 is formed with a continuous flange 155 that is at a location so as to retain the released clamp 33 as in the previously described embodiment.

It should be readily apparent from the foregoing description that a number of embodiments of the invention have been illustrated and described, each of which provides a very effective device for insuring that a released hose clamp will not slide down an exhaust pipe to an inaccessible location. Although a number of embodiments of the invention have teen illustrated and described, various changes and modifications may be made without departing from the spirit and scope of the invention as defined by the appended claims.

We claim;

1. In a fluid connection between a rigid conduit, a flexible conduit adapted to be telescopically received with said rigid conduit and releasable clamping means for retaining said conduits together, the improvement comprising a projection on said rigid conduit position and provided for the sole purpose of engaging said clamping means when said clamping means is released for retaining said clamping means.

2. In a fluid connection as set forth in claim 1 wherein the projection is formed on an outer wall of the rigid conduit in proximity to the area engaged by the flexible conduit but spaced sufficiently therefrom to permit disassembly.

3. In a fluid connection as set forth in claim 2 wherein the projection is formed integrally on the rigid conduit.

4. In a fluid connection as set forth in claim 1 wherein the rigid conduit extends in a generally vertical direction.

5. In a fluid connection as set forth in claim 4 wherein the projection is formed on an outer wall of the rigid conduit in proximity to the area engaged by the flexible conduit but spaced sufficiently therefrom to permit disassembly.

6. In a fluid connection as set forth in claim 5 wherein the projection is formed integrally on the rigid conduit.

7. In a fluid connection as set forth in claim 4 wherein the projection extends below all clamping means associated with the rigid conduit.

8. In a fluid connection as set forth in claim 1 in combination with a marine outboard drive including an internal combustion engine positioned within the hull of a watercraft and driving an outboard drive unit mounted on the transom of the watercraft and wherein the conduits form a portion of the exhaust system for the engine.

9. In a fluid connection as set forth in claim 8 wherein the rigid conduit extends in a generally vertical direction.

10. In a fluid connection as set forth in claim 9 wherein the projection is formed on an outer wall of the rigid conduit in proximity to the area engaged by the flexible conduit but spaced sufficiently therefrom to permit disassembly.

11. In a fluid connection as set forth in claim 10 wherein the projection is formed integrally on the rigid conduit.

12. In a fluid connection as set forth in claim 9 wherein the projection is formed vertically below all flexible conduits in the exhaust system.

13. In a fluid connection as set forth in claim 8 wherein the projection is formed vertically below all flexible conduits in the exhaust system.

* * * * *